US006960059B2

(12) United States Patent
Chang et al.

(10) Patent No.: US 6,960,059 B2
(45) Date of Patent: Nov. 1, 2005

(54) BLOWER WITH A PLURALITY OF IMPELLERS

(75) Inventors: Shun-Chen Chang, Ying Ko Town (TW); Kuo-Cheng Lin, Tao Yuan (TW); Wen-Shi Huang, Jung Li (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 10/348,907

(22) Filed: Jan. 23, 2003

(65) Prior Publication Data

US 2004/0101399 A1 May 27, 2004

(30) Foreign Application Priority Data

Nov. 21, 2002 (TW) ..... 91134007 A

(51) Int. Cl.[7] ..... F04D 13/02

(52) U.S. Cl. ..... 415/65; 415/102; 416/198 R; 416/201 A; 416/203

(58) Field of Search ..... 415/65, 67, 68, 415/102, 198.1; 416/122, 124, 198 R, 201 A, 203, 120, 126

(56) References Cited

U.S. PATENT DOCUMENTS

| | | | | | |
|---|---|---|---|---|---|
| 1,462,592 | A | * | 7/1923 | Bentley | 417/247 |
| 2,228,425 | A | * | 1/1941 | Venderbush | 96/282 |
| 2,251,553 | A | * | 8/1941 | Redmond | 417/350 |
| 3,083,893 | A | * | 4/1963 | Dean | 417/247 |
| 4,361,427 | A | * | 11/1982 | Barradas | 96/135 |

* cited by examiner

*Primary Examiner*—Ninh H. Nguyen

(57) ABSTRACT

A blower having a plurality of impellers is described. The blower has two driving devices and two impellers respectively mounted on the two driving devices. The blades of the two impellers, which are radially or axially disposed, are overlapped so as to enhance the heat-dissipating efficiency of the blower.

24 Claims, 4 Drawing Sheets

BLOWER WITH A PLURALITY OF IMPELLERS

BACKGROUND OF THE INVENTION

1. Field of Invention

The present invention relates to a blower. More particularly, the present invention relates to a blower with a plurality of impellers.

2. Description of Related Art

The blower is one of the high-performance dissipation devices on the market. Basically, the blower is suitable for installation in a high impedance system.

Blower size and volume need to be reduced even if blower performance is high. The reduced size is essential if the blower is to fit in smaller mobile electronic devices such as notebook computers and tablet PCs.

Further, the blower must not fail during system operation. In fact, in order to protect the system, power automatically turns off if the blower malfunctions. Therefore, a backup blower is added to the system to avoid failure. Adding extra blower must occupy more space, and this is undesirable.

SUMMARY OF THE INVENTION

It is therefore an objective of the present invention to provide a blower with a plurality of impellers in order to improve heat dissipation efficiency.

In accordance with the foregoing and other objectives of the present invention, a blower having a plurality of impellers is disclosed. The blower has two driving devices and two impellers respectively mounted on the two driving devices. The blades of the two impellers, which are radially or axially disposed, are overlapped so as to enhance heat-dissipating efficiency of the blower.

In one preferred embodiment of the present invention, two impellers and two driving means are disposed in one case, in which the blades of the two impellers are overlapped axially. The diameters of two impellers are the same.

In another preferred embodiment of the present invention, two impellers and two driving means are disposed in one case, in which the blades of two impellers are overlapped radially. The diameters of the two impellers are different.

In a further preferred embodiment of the present invention, two impellers and two driving means are disposed in one case, in which the blades of two impellers are overlapped obliquely. The diameters of the two impellers may be different or identical.

In light of the preferred embodiments of the present invention, at least two driving means are employed to drive the impellers avoid system failure in the event that one of the at least two driving means malfunctions and causes system failure. In addition, the present invention provides flexible design patterns, such as rotating directions and air inlet options. Two blowers disposed radially not only shrink the volume of the blower but also increase the flow rate of passing air.

It is to be understood that both the foregoing general description and the following detailed description examples only, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1A:
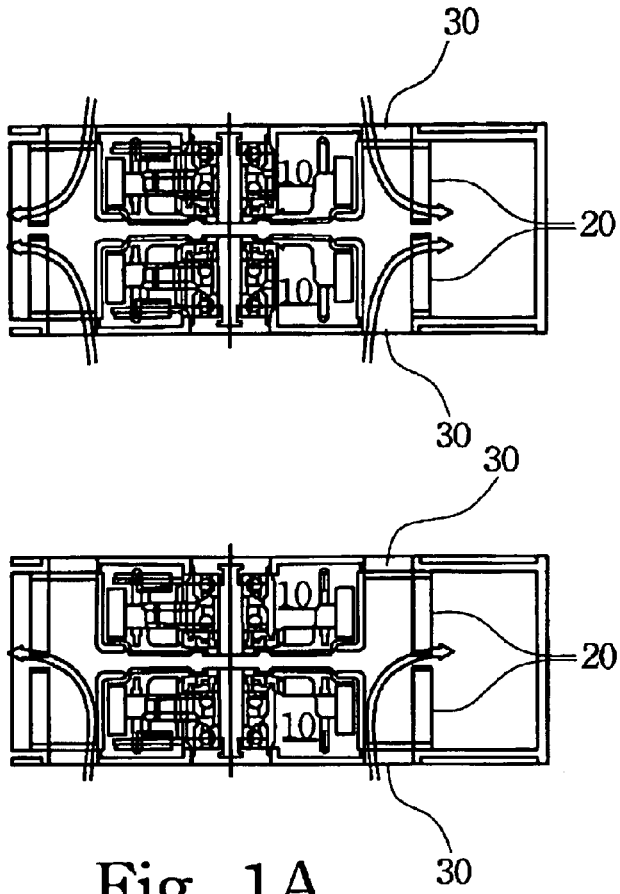
FIG. 1A illustrates a cross-sectional sideview of a blower cross-sectional according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

The easiest way to reduce the volume of the blower is to shrink the impeller structure, driving means (such as motor), and outer case of the blower. The method of present invention is to assemble multiple driving means and impellers in one case, thus reducing the volume of the blower and avoiding the risk of only one driving means.

In one preferred embodiment of the present invention, multiple driving means and impellers are disposed in one case and the blades of the impellers are overlapped to reduce the volume. Thus, the present invention focuses on how to overlap the blades of the impellers.

Figure 1B:
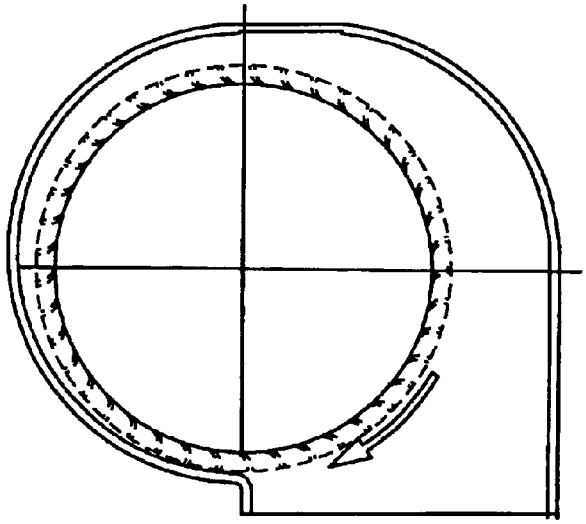
FIG. 1B illustrates cross-sectional top view of FIG. 1A.
Figure 3A:
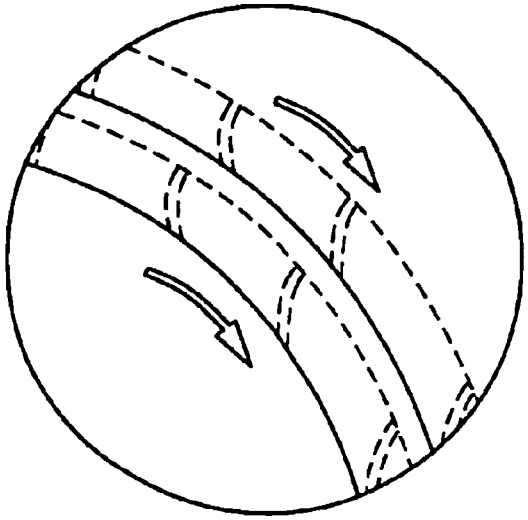
FIGS. 3A, 3B illustrate the blade design and rotating directions according to one preferred embodiment of this invention.
Figure 3B:
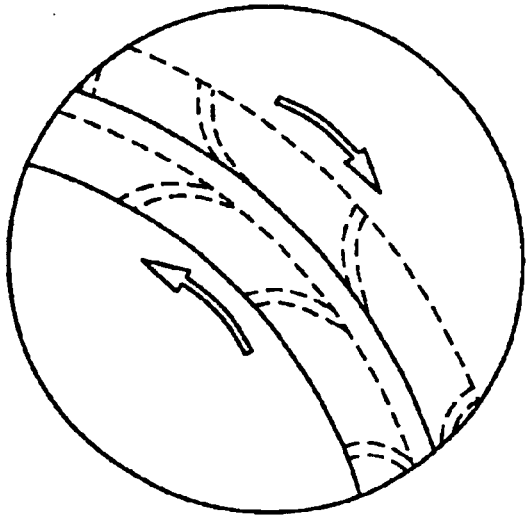

FIG. 1A illustrates a cross-sectional sideview of a blower according to one preferred embodiment of the present invention. FIG. 1B illustrates a top view of FIG. 1A. In one preferred embodiment of the present invention, the blades 20 of two blowers are disposed axially. A gap separating the impellers 30 is desirable to avoid contact between the same. FIG. 1A is divided into two illustrations. In the upper illustration, inlets are located in both sides of the blower, while in the lower illustration one inlet is located in either side of the blower. With regard to the rotational direction, the two blowers can rotate in either identical or opposite directions (as shown in FIGS. 3A and 3B). In particular, the blades should be designed as illustrated in FIG. 3A if rotational directions of two blowers are identical. The blades should be designed as in FIG. 3B if rotational directions of two blowers are opposite.

Figure 4A:
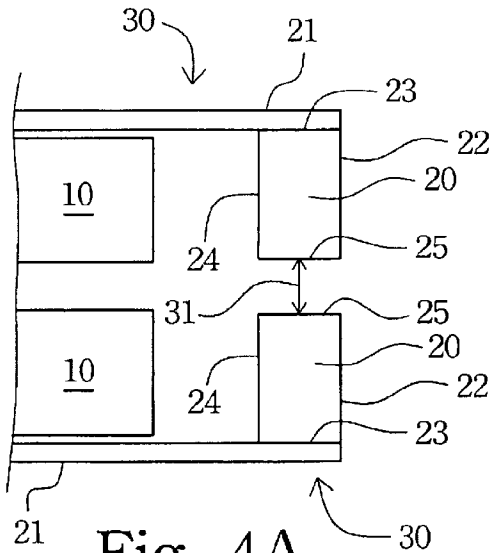
FIGS. 4A–4D illustrate patterns of overlap according to one preferred embodiment of this invention.
Figure 4B:
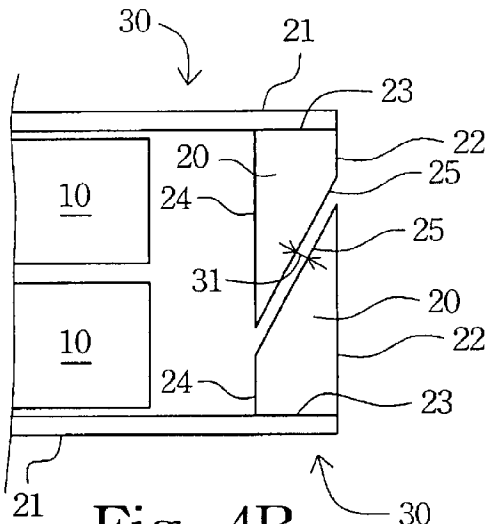
Figure 4C:
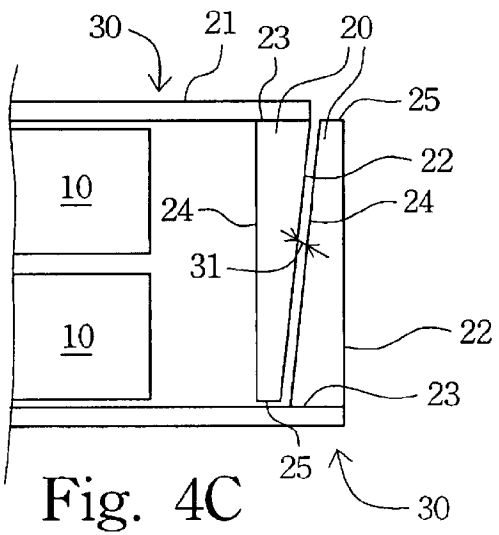
Figure 4D:
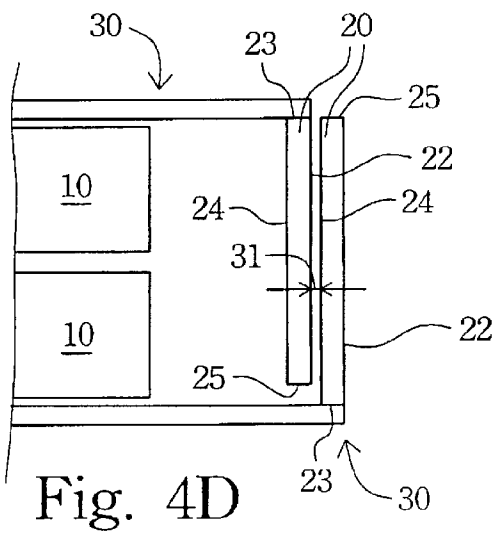

FIG. 4A illustrates enlarged details of the blades in FIG. 1A. The blade design can have different types of patterns. For example, the blades of two impellers overlap obliquely in FIG. 4B. The diameters of the two impellers are the same both in FIG. 4A and FIG. 4B. Alternatively, the blades of two impellers overlap radially (FIG. 4D). The blades of the two impellers also overlap obliquely in FIG. 4C, but the diameters of the two impellers there illustrated are different.

Referring to FIG. 4A again, the two impellers 30 are described in more detail. The impeller 30 includes a base 21 and a plurality of blades 20. The blade 20 further includes a root portion 23, an inner edge 24, an outer edge 22, and a front edge 25. The root portion 23 couples to the base 21 along a radial direction of the base 21. The blade 20 protrudes from the base 21 along a direction perpendicular to the base 21. Therefore, the outer edge 22 and the inner edge 24 are both perpendicular to the base 21. The two impellers 30 are disposed oppositely and the blades 20 are both quadrilaterals, for example, rectangles. Accordingly, the front edges 25 perpendicular to the outer edge 22 and the inner edges 24 are parallel to each other with a gap 31. Additionally, the outer edges 22 of the two impellers 30 are parallel to each other and the inner edges 24 of the two impellers 30 are parallel to each other. Preferably, the two impellers 30 are identical. Therefore, the outer edges 22 aim at each other and the inner edges 24 aim at each other.

Referring to FIG. 4B again, the two impellers 30 are described in more detail. The impeller 30 includes a base 21 and a plurality of blades 20. The blade 20 further includes a root portion 23, an inner edge 24, an outer edge 22, and a front edge 25. The root portion 23 couples to the base 21 along a radial direction of the base 21. The blade 20 protrudes from the base 21 along a direction perpendicular to the base 21. Therefore, the outer edge 22 and the inner edge 24 are both perpendicular to the base 21. The two impellers 30 are disposed oppositely and the blades 20 are both quadrilaterals. The front edges 25 of the two impellers 30 are oblique to the outer edge 22 and the inner edges 24, and are parallel to each other with a gap 31. Additionally, the outer edges 22 of the two impellers 30 are parallel to each other and the inner edges 24 of the two impellers 30 are parallel to each other. Preferably, the outer edges 22 aim at each other and the inner edges 24 aim at each other.

Referring to FIG. 4C again, the two impellers 30, a large impeller and a small impeller, are described in more detail. The impeller 30 includes a base 21 and a plurality of blades 20. The blade 20 further includes a root portion 23, an inner edge 24, an outer edge 22, and a front edge 25. The root portion 23 couples to the base 21 along a radial direction of the base 21. The blade 20 protrudes from the base 21 along a direction perpendicular to the base 21. Therefore, the outer edge 22 of the large impeller 30 and the inner edge 24 of the small impeller 30 are both perpendicular to the base 21. The large impeller 30 surrounds the small impeller 30, and the large impeller 30 and the small impeller 30 are opposite to each other. The outer edge 22 of the small impeller 30 and the inner edge 24 of the large impeller 30 are parallel to each other with a gap 31 and are both oblique.

Referring to FIG. 4D, the two impellers 30, a large impeller and a small impeller, are described in more detail. The impeller 30 includes a base 21 and a plurality of blades 20. The blade 20 further includes a root portion 23, an inner edge 24, an outer edge 22, and a front edge 25. The root portion 23 couples to the base 21 along a radial direction of the base 21. The blade 20 protrudes from the base 21 along a direction perpendicular to the base 21. The outer edge 22 and the inner edge 24 are both perpendicular to the base 21. The large impeller 30 surrounds the small impeller 30, and the large impeller 30 and the small impeller 30 are opposite to each other. The outer edge 22 of the small impeller 30 and the inner edge 24 of the large impeller 30 are parallel to each other with a gap 31.

Figure 2A:
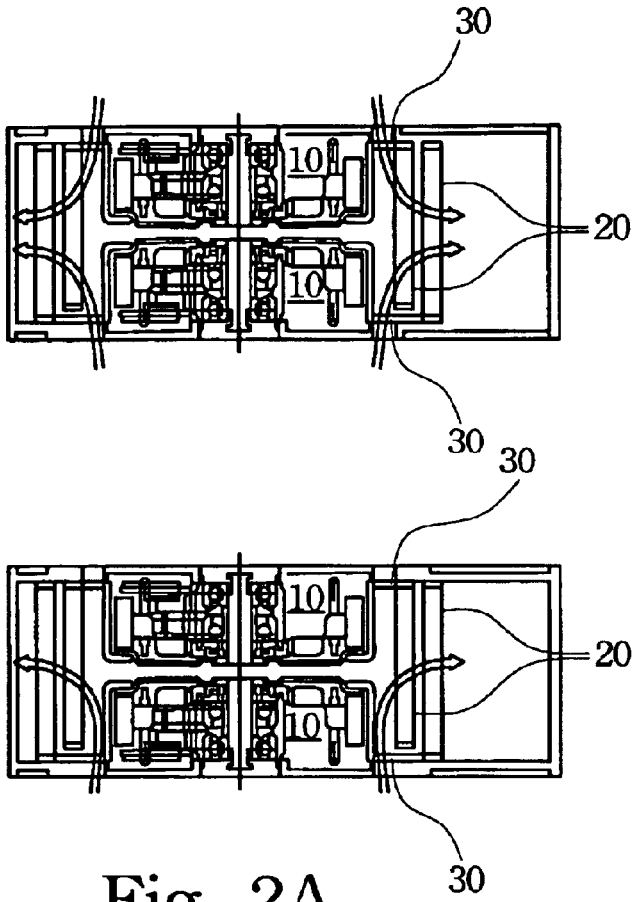
FIG. 2A illustrates a cross-sectional sideview of a blower according to another preferred embodiment of this invention.
Figure 2B:
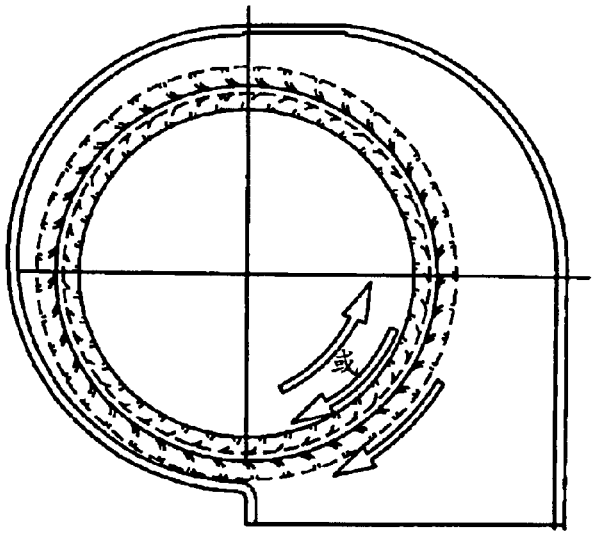
FIG. 2B illustrates cross-sectional top view of FIG. 2A.

FIG. 2A illustrates a cross-sectional view of a blower according to another preferred embodiment of this invention. FIG. 2B illustrates a top view of FIG. 2A. In another preferred embodiment of the present invention, the blades 20 of two blowers are disposed radially. A gap separating the two impellers 30 is desirable to avoid contact between the same. Radial disposition of the two blowers not only shrink the volume of the blower but also increase the flow rate of passing air. FIG. 2A is divided into two illustrations. In the upper illustration, inlets are located in both sides of the blower, while in the lower illustration one inlet is located in either side of the blower. Rotational direction of two blowers can be identical or opposite (as shown in FIGS. 3A and 3B). In particular, the blades should be designed as in FIG. 3A if rotational directions of two blowers are identical. The blades should be designed as in FIG. 3B if rotational directions of two blowers are opposite.

Although the present invention has been described in considerable detail with reference to certain preferred embodiments thereof, other embodiments are possible. For example, in the preferred embodiments, two blowers are disposed axially and radially to shrink the volume of the blower, but more blowers (at least three blowers) can be disposed axially and radially to achieve the same purpose. Therefore, their spirit and scope of the appended claims should no be limited to the description of the preferred embodiments contained herein.

In light of the preferred embodiments of the present invention, at least two driving means are employed to drive the impellers and avoid system failure cause by malfunction of one of the at least two driving means. In addition, the present invention provides flexible design patterns, such as rotating directions and air inlet options. Two blowers disposed radially not only shrink the volume of the blower but also increase the flow rate of passing air.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A blower, comprising:

a first impeller;

a second impeller;

a first driving means mounted inside the first impeller; and a second driving means mounted inside the second impeller, wherein the first impeller and the second impeller respectively have a plurality of blades with end edges extending toward each other in opposite directions.

2. The blower of claim 1, wherein said end edges of said blades of said first impeller and said second impeller are shaped to correspond to each other.

3. The blower of claim 1, wherein said end edges of blades of said first impeller and said second impeller are shaped in parallel.

4. The blower of claim 1, wherein said end edges of said blades of said first impeller and said second impeller have oblique surfaces.

5. The blower of claim 1, wherein rotational directions of said first impeller and said second impeller are identical.

6. The blower of claim 1, wherein rotational directions of said first impeller and said second impeller are opposite.

7. The blower of claim 1, wherein said driving means is a motor.

8. The blower of claim 1, wherein the first driving means is employed to drive the first impeller to avoid a system failure in the event that the second driving means malfunctions.

9. The blower of claim 1, wherein said end edge of said first impeller extends toward a second base of said second impeller and said end edge of said second impeller extends toward a first base of said first impeller.

10. The blower of claim 1, wherein said first impeller and said second impeller are in a substantially mirror image disposition.

11. A blower, comprising at least two impellers, wherein said adjacent two impellers respectively have a plurality of blades with end edges extending toward each other in opposite directions, wherein each of the at least two impellers has a corresponding driving means disposed inside.

12. The blower of claim 11, wherein said end edges of said blades of said adjacent two impellers are shaped to correspond to each other.

13. The blower of claim 11, said end edges of said blades of said adjacent two impellers are shaped in parallel.

14. The blower of claim 11, wherein said end edges of said blades of said adjacent two impellers have oblique surfaces.

15. The blower of claim 11, wherein rotating directions of said adjacent two impellers are identical.

16. The blower of claim 11, wherein rotational directions of said adjacent two impellers are opposite.

17. The blower of claim 11, further comprising at least one driving means to drive said impellers.

18. A blower, comprising:

a first impeller;

a second impeller;

a first driving means mounted inside the first impeller; and a second driving means mounted inside the second impeller, wherein the first impeller and the second impeller have opposing edges adjacent to one another and rotation directions of said first impeller and said second impeller are identical.

19. A blower, comprising a first impeller and a second impeller, each of the impellers having a base, a hub and a plurality of blades disposed on the base and around the hub, wherein each of the blades of the first and second impellers further comprises an end edge extending out from the base and toward to each other in opposite directions, wherein each of the first and second impellers has a corresponding driving means disposed inside the hub thereof.

20. The blower of claim 19, wherein the first impeller and the second impeller are in substantially mirror image disposition.

21. The blower of claim 19, wherein the end edges of the first impeller are formed in parallel to those of the second impeller.

22. The blower of claim 19, wherein the end edges of the blades of the first and second impellers have oblique surface.

23. The blower of claim 19, wherein each blades of the first impeller has side edges, respectively proximal and distal to the hub, aligned with those of the second impeller.

24. The blower of claim 19, wherein the end edges of the blades of the first and second impellers extend beyond a top surface of the hub and toward to the base of each other.

* * * * *